US012295533B2

(12) United States Patent
Jung et al.

(10) Patent No.: US 12,295,533 B2
(45) Date of Patent: May 13, 2025

(54) ROBOT CLEANER

(71) Applicant: EVERYBOT INC, Seongnam-si (KR)

(72) Inventors: Woo Chul Jung, Seongnam-si (KR); Min Gyu Kim, Seoul (KR)

(73) Assignee: EVERYBOT INC, Seongnam-si (KR)

( * ) Notice: Subject to any disclaimer, the term of this patent is extended or adjusted under 35 U.S.C. 154(b) by 242 days.

(21) Appl. No.: 17/776,787

(22) PCT Filed: Nov. 2, 2021

(86) PCT No.: PCT/KR2021/015696

§ 371 (c)(1),
(2) Date: May 13, 2022

(87) PCT Pub. No.: WO2022/139160

PCT Pub. Date: Jun. 30, 2022

(65) Prior Publication Data

US 2023/0157512 A1 May 25, 2023

(30) Foreign Application Priority Data

Dec. 23, 2020 (KR) ..... 10-2020-0182204

(51) Int. Cl.
*A47L 11/40* (2006.01)
*A47L 11/28* (2006.01)

(52) U.S. Cl.
CPC ..... *A47L 11/4088* (2013.01); *A47L 11/28* (2013.01); *A47L 11/4038* (2013.01); *A47L 2201/00* (2013.01)

(58) Field of Classification Search
CPC .... B08B 1/32; A47L 2201/00; A47L 11/4038; A47L 11/28; A47L 11/4088
USPC ..... 15/98, 4
See application file for complete search history.

(56) References Cited

U.S. PATENT DOCUMENTS

2019/0328193 A1* 10/2019 Yang ..... A47L 11/4088

FOREIGN PATENT DOCUMENTS

| | | | | |
|---|---|---|---|---|
| CN | 111870196 | A | 11/2020 | |
| KR | 10-0635641 | B1 | 10/2006 | |
| KR | 10-1613446 | B1 | 4/2016 | |
| KR | 10-2019-0025971 | A | 3/2019 | |
| KR | 1966083 | B1 * | 4/2019 | ..... A47L 11/4038 |
| KR | 10-2019-0125912 | A | 11/2019 | |

* cited by examiner

*Primary Examiner* — Katina N. Henson
(74) *Attorney, Agent, or Firm* — Bridgeway IP Law Group, PLLC; Sang Ho Lee; Hyun Woo Shin

(57) ABSTRACT

Provided is a robot cleaner in which a liquid may be uniformly supplied to a plurality of cleaners and which is easily inspected and repaired in case of defects such as water leakage. The robot cleaner includes a main body portion; a plurality of cleaner fixing portions provided at a lower portion of the main body portion, a plurality of cleaners for wet cleaning being fixed to the plurality of cleaner fixing portions, respectively; a liquid supply portion provided in the main body portion and storing a liquid and supplying the stored liquid to at least one of the plurality of cleaners; a liquid distribution member provided at a lower portion of the main body portion and directly supplying the stored liquid to at least one cleaner of the plurality of cleaners; and a flow path portion providing a movement path of the liquid from the liquid supply portion to the liquid distribution member.

13 Claims, 15 Drawing Sheets

ROBOT CLEANER

TECHNICAL FIELD

The present invention relates to a robot cleaner, and more particularly, to a robot cleaner in which a liquid may be uniformly supplied to a plurality of cleaners and which is easily inspected and repaired in case of defects such as water leakage.

BACKGROUND ART

In general, a robot cleaner for wet cleaning has a liquid supply portion such as a water bottle at an upper portion and a liquid is supplied to a plurality of cleaners provided at a lower portion of the robot cleaner through a flow path formed inside the robot cleaner.

However, in the related art robot cleaner for wet cleaning, the flow path formed therein is configured as a hose formed of a flexible material, a plurality of the hoses are provided in a complicated manner, and lengths of the plurality of hoses are different from each other so that it is difficult to uniformly supply water to a plurality of cleaners.

In addition, in the related art robot cleaner for wet cleaning, a cause of defects is always present due to the complicated hose structure, and in case of defects, it is difficult to check and repair the robot cleaner.

DISCLOSURE

Technical Problem

An object of the present invention is to provide a robot cleaner which may be easily inspected and repaired when a problem such as clogging of a nozzle occurs because a liquid distribution member having a nozzle through which a liquid is ejected may be easily detached.

Another object of the present invention is to provide a robot cleaner in which a flow path portion for moving a liquid provided inside the robot cleaner is easily manufactured and manufacturing costs are reduced.

Another object of the present invention is to provide a robot cleaner in which a liquid may be uniformly supplied to a plurality of cleaners provided in the robot cleaner.

Another object of the present invention is to provide a robot cleaner in which the liquid distribution member is installed at a lower portion of the robot cleaner, so that water leakage, may be easily identified with the naked eyes as it occurs, and a liquid does not flow into an inside of the robot cleaner even when water leakage occurs.

Technical Solution

According to an exemplary embodiment of the present invention, a robot cleaner may include: a main body portion; a plurality of cleaner fixing portions provided at a lower portion of the main body portion, a plurality of cleaners for wet cleaning being fixed to the plurality of cleaner fixing portions, respectively; a liquid supply portion provided in the main body portion and storing a liquid and supplying the stored liquid to at least one of the plurality of cleaners; a liquid distribution member provided at a lower portion of the main body portion and directly supplying the stored liquid to at least one cleaner of the plurality of cleaners; and a flow path portion providing a movement path of the liquid from the liquid supply portion to the liquid distribution member.

Also, in an exemplary embodiment of the present invention, the liquid distribution member may have at least one nozzle, through which the liquid is ejected, at a position corresponding to the at least one cleaner, and the liquid may be directly supplied to the at least one cleaner through the at least one nozzle.

Also, in an exemplary embodiment of the present invention, the liquid distribution member may be detachably connectable to the lower portion of the main body portion.

Also, in an exemplary embodiment of the present invention, the liquid distribution member may be provided between the plurality of cleaner fixing portions.

In addition, in an exemplary embodiment of the present invention, the at least one nozzle may be provided in plurality, and a specific nozzle, among the plurality of nozzles, may be disposed to face a floor surface, so that the liquid may be directly supplied to the floor surface through the specific nozzle.

Also, in an exemplary embodiment of the present invention, the plurality of cleaners, the plurality of cleaner fixing portions, and the at least one nozzle may each be three in number, the liquid distribution member may be provided between the three cleaner fixing portions, and the specific nozzle among the three nozzles may be provided in the liquid distribution member to directly supply the liquid to the floor surface, without directly supplying the liquid to any of the three cleaners.

Also, in an exemplary embodiment of the present invention, the main body portion may include a first upper case and a first lower case coupled to each other, the liquid distribution member may be provided in the first lower case, a first water leakage preventing member may be provided between the first upper case and the flow path portion, and a second water leakage preventing member may be provided between the first lower case and the liquid distribution member.

In addition, in an exemplary embodiment of the present invention, a hole connected to an end of the flow path portion may be formed at an upper portion of the liquid distribution member, the liquid may be supplied from the flow path portion through the hole, and the at least one nozzle may be formed at a lower portion of the liquid distribution member.

Also, in an exemplary embodiment of the present invention, a plurality of ducts respectively extending toward the plurality of cleaner fixing portions may be formed inside the liquid distribution member, and the plurality of ducts may be filled with the liquid.

Also, in an exemplary embodiment of the present invention, the liquid distribution member may include a second upper case and a second lower case coupled to each other, the hole may be formed in the second upper case, and the at least one nozzle may be formed in the second lower case.

Also, in an exemplary embodiment of the present invention, the second upper case may be formed integrally with the main body portion at a lower portion of the main body portion or may be a separate object from the main body portion.

In addition, in an exemplary embodiment of the present invention, a third water leakage preventing member may be provided between the second upper case and the second lower case.

In addition, in an exemplary embodiment of the present invention, the flow path portion may include a pump for moving the liquid passing through the flow path portion and a check valve for preventing the liquid present in the flow path portion from being ejected to the outside of the robot cleaner when the pump does not operate.

In addition, in an exemplary embodiment of the present invention, the flow path portion may further include a first flow path through which the liquid supplied from the liquid supply portion passes first, a second flow path connecting the first flow path to the pump, a third flow path connecting the pump to the check valve, and a fourth flow path connecting the check valve to the liquid distribution member, wherein the liquid supplied from the liquid supply portion may reach the liquid distribution member sequentially by passing through the first flow path, the second flow path, the pump, the third flow path, the check valve, and the fourth flow path.

In addition, in an exemplary embodiment of the present invention, the second flow path, the third flow path, and the fourth flow path may be formed of a flexible material.

Advantageous Effects

The robot cleaner according to the present invention has the following effects.

According to the present invention, the liquid distribution member including a nozzle from which a liquid is discharged may be easily detached, so that the robot cleaner may be easily inspected and repaired when a problem such as clogging of the nozzle occurs.

In addition, according to the present invention, a flow path portion for moving a liquid provided inside the robot cleaner may be easily manufactured and manufacturing costs may be reduced.

In addition, according to the present invention, a liquid may be uniformly supplied to a plurality of cleaners provided in the robot cleaner.

In addition, according to the present invention, since a liquid distribution member is installed at a lower portion of the robot cleaner, it is easy to identify with the naked eyes when water leakage occurs, and even if water leakage occurs, the liquid may not flow into an inside of the robot cleaner.

However, the scope of the present invention is not limited by the aforementioned effects.

BEST MODE

Figure 1:
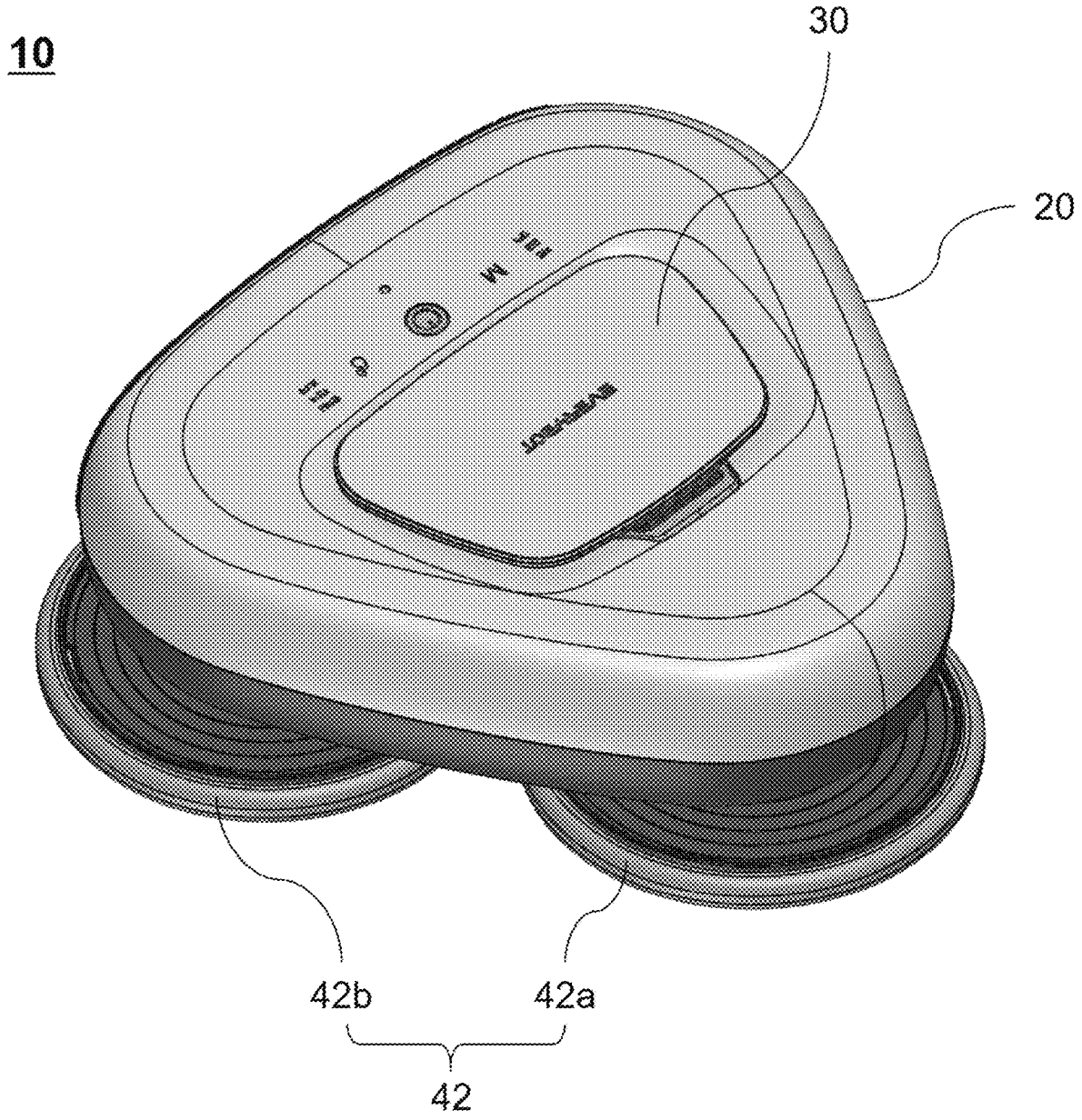
FIG. 1 is a top view of a robot cleaner according to an exemplary embodiment of the present invention.

Matters relating to an operation and effect including a technical configuration for the above purpose of a robot cleaner according to the present invention will be clearly understood by the detailed description below with reference to the drawings in which an exemplary embodiment of the present invention is shown.

The following description illustrates only a principle of the present invention. Therefore, those skilled in the art may implement the principle of the present invention and devise various apparatuses included in the spirit and scope of the present invention although not clearly described or shown in the present specification. In addition, it is to be understood that all conditional terms and exemplary embodiments mentioned in the present specification are obviously intended only to allow those skilled in the art to understand a concept of the present invention in principle, and the present invention is not limited to exemplary embodiments and states particularly mentioned as such.

Further, it is to be understood that all detailed descriptions mentioning specific exemplary embodiments of the present invention as well as principles, aspects, and exemplary embodiments of the present invention are intended to include structural and functional equivalences thereof. Further, it is to be understood that these equivalences include an equivalence that will be developed in the future as well as an equivalence that is currently well-known, that is, all devices devised so as to perform the same function regardless of a structure.

Further, in describing the present invention, in the case in which it is determined that a detailed description of a known technology associated with the present invention may unnecessarily make the gist of the present invention unclear, it will be omitted. Additionally, components shown in the accompanying drawings are not necessarily shown to scale. For example, sizes of some components shown in the accompanying drawings may be exaggerated as compared with other components in order to assist in the understanding of exemplary embodiments of the present invention. Like reference numerals on different drawings will denote like components, and similar reference numerals on different drawings will denote similar components, but are not necessarily limited thereto.

The present invention defined by such claims is connected to other functions provided by various means in a method defined by the claims. Thus, any means that may provide the function should be understood to be equivalent to what is figured out from the specification.

The aforementioned objects, features, and advantages will become obvious from the following detailed description provided in relation to the accompanying drawings. Therefore, those skilled in the art to which the present invention pertains may easily practice a technical idea of the present invention.

Hereinafter, various exemplary embodiments according to the technical spirit of the present invention will be described in detail with reference to the accompanying drawings.

Figure 2:
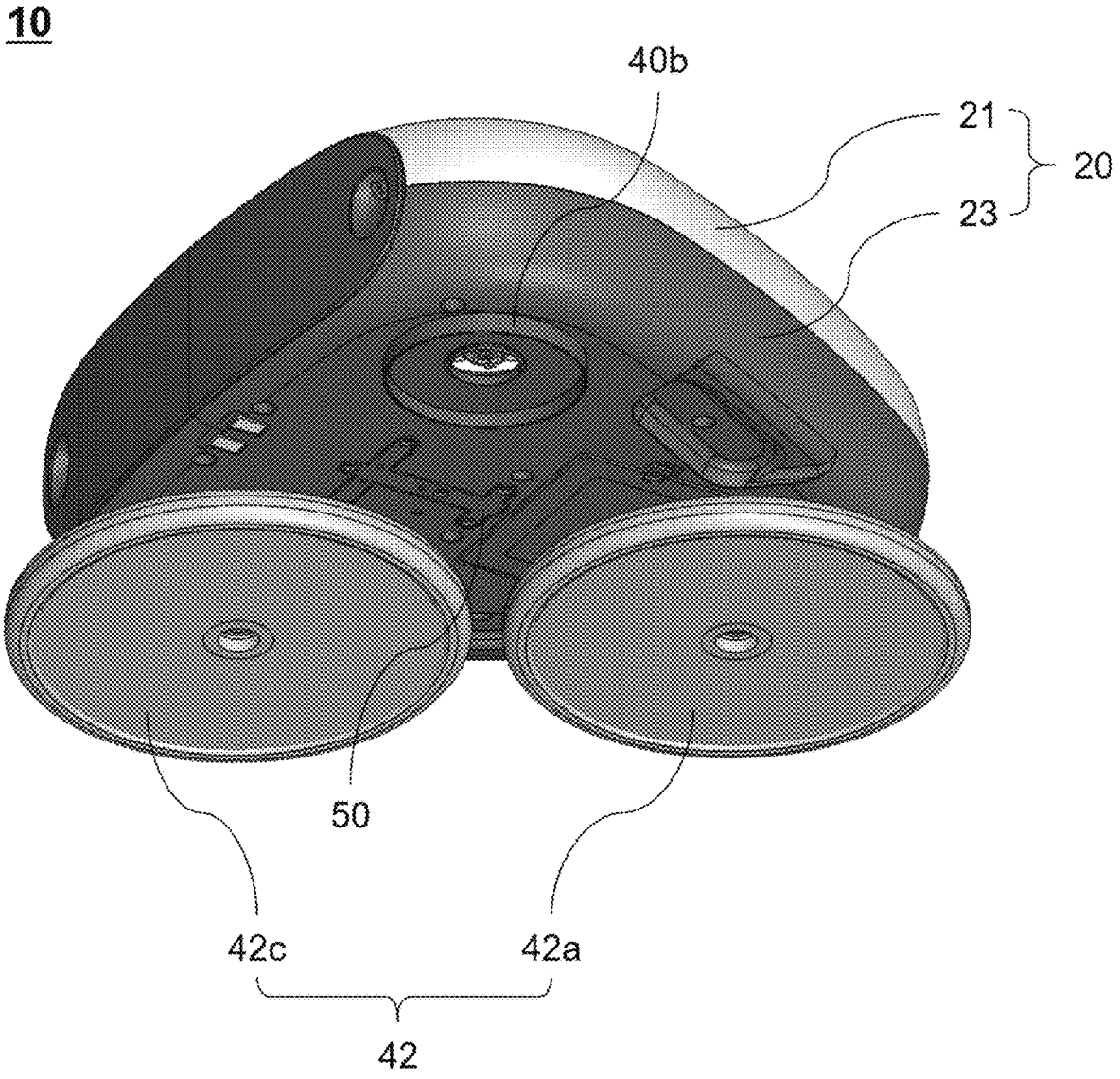
FIG. 2 is a bottom view of a robot cleaner according to an exemplary embodiment of the present invention.

FIGS. 1 and 2 are diagrams showing an exterior of a robot cleaner to which the present invention is applied according to an example. FIG. 1 is a top view of a robot cleaner according to an exemplary embodiment of the present invention, and FIG. 2 is a bottom view of a robot cleaner according to an exemplary embodiment of the present invention.

Referring to FIGS. 1 and 2, the robot cleaner 10 according to an exemplary embodiment of the present invention may basically include a main body portion 20, a liquid supply portion 30, a plurality of cleaner fixing portions 40, and a liquid distribution member 50.

The main body portion 20 may include a first upper case 21 and a first lower case 23. The first upper case 21 and the first lower case 23 may be coupled to each other to constitute a housing of the robot cleaner 10 according to an exemplary embodiment of the present invention.

The plurality of cleaner fixing portions 40; 40*a*, 40*b*, and 40*c* are provided at a lower portion of the main body portion 20, and may fix a plurality of cleaners 42; 42*a*, 42*b*, and 42*c* for wet cleaning, respectively.

In this disclosure, an example in which the plurality of cleaner fixing portions 40 and the plurality of cleaners 42 are provided as three cleaner fixing portions and three cleaners in the robot cleaner 10 will be mainly described. However, it should be clearly appreciated that the plurality of cleaner fixing portions 40 and the plurality of cleaners 42 are not limited to three cleaner fixing portions and three cleaners in the technical idea of the present invention.

The liquid supply portion 30 may be provided in the main body portion 20 and stores a liquid to supply the stored liquid to at least one of the plurality of cleaners 42.

The liquid stored in the liquid supply portion 30 may be water or may be a mixture of water and other ingredients such as detergent.

Figure 3:
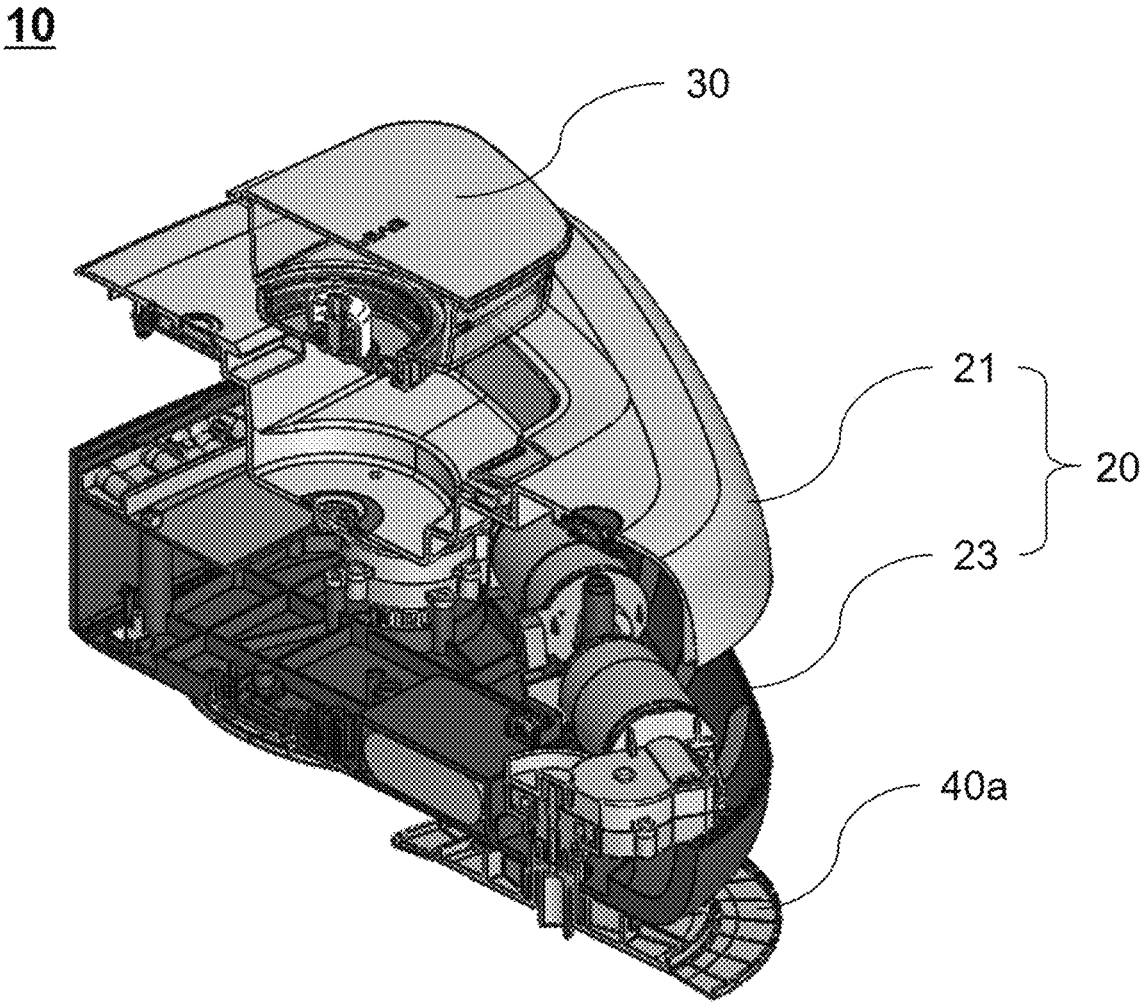
FIG. 3 is an exploded view of a portion of a robot cleaner according to an exemplary embodiment of the present invention.

FIG. 3 is an exploded view of a portion of a robot cleaner according to an exemplary embodiment of the present invention. Referring to FIG. 3, the liquid supply portion 30 is detachably connectable to the main body portion 20.

A user may separate the liquid supply portion 30 from the main body portion 20, fill the liquid supply portion 30 with a liquid such as water, and then mount the liquid supply portion 30 to the main body portion 20 again.

The liquid distribution member 50 is a component provided at a lower portion of the main body portion 20 and directly supplying the liquid to at least one of the plurality of cleaners 42.

In addition, as described below, the robot cleaner 10 according to an exemplary embodiment of the present invention may further include a flow path portion providing a movement path of the liquid stored in the liquid supply portion 30 from the liquid supply portion 30 to the liquid distribution member 50.

For example, the flow path portion may be disposed inside the main body portion 20.

Hereinafter, a liquid supply structure of the robot cleaner 10 according to an exemplary embodiment of the present invention will be described in detail with reference to the necessary drawings.

First, the flow path portion providing a movement path for the liquid starting from the liquid supply portion 30 to reach the liquid distribution member 50 will be described.

Figure 4:
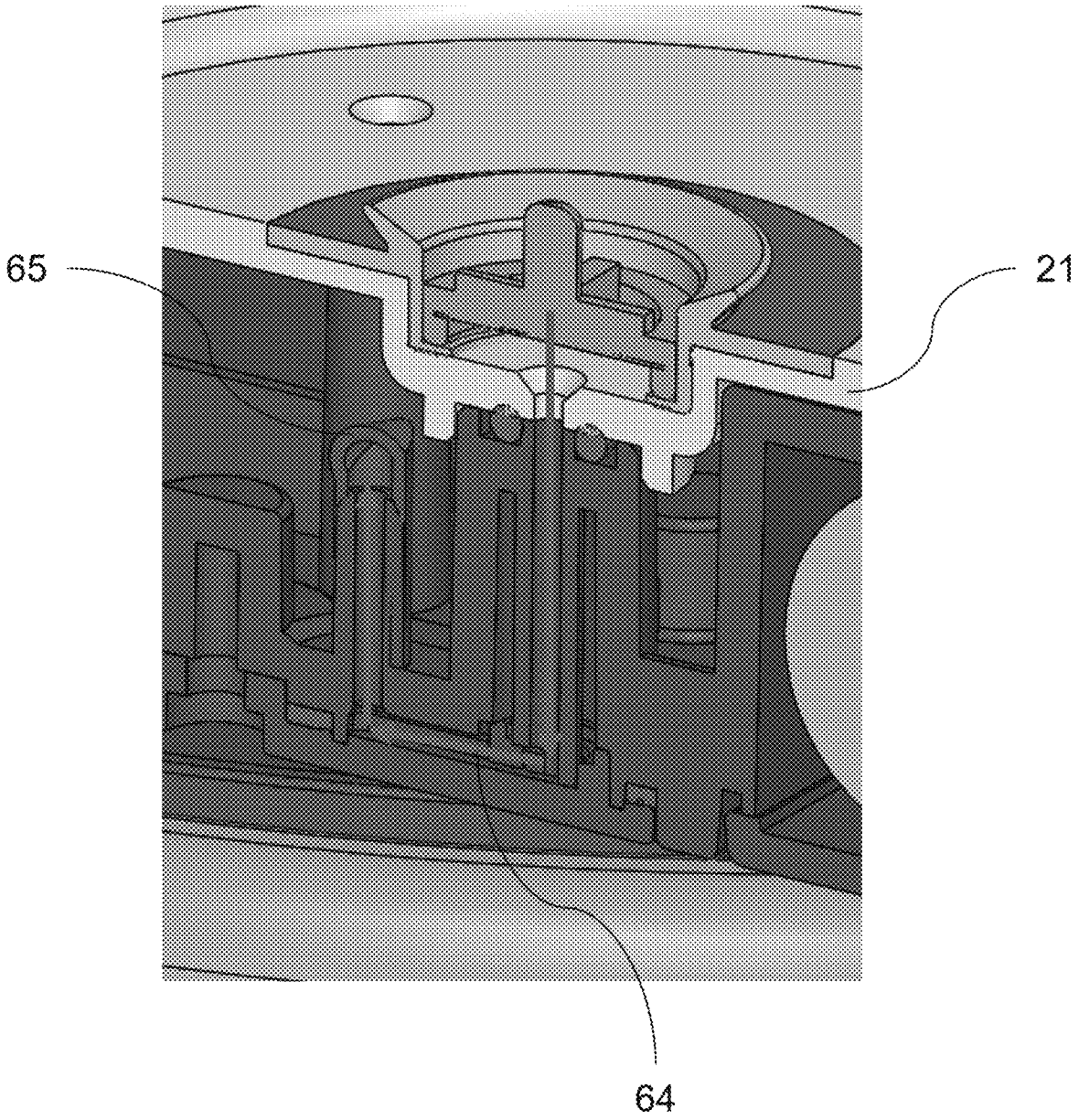
FIGS. 4 and 5 are views illustrating a flow path portion according to an exemplary embodiment of the present invention.
Figure 5:
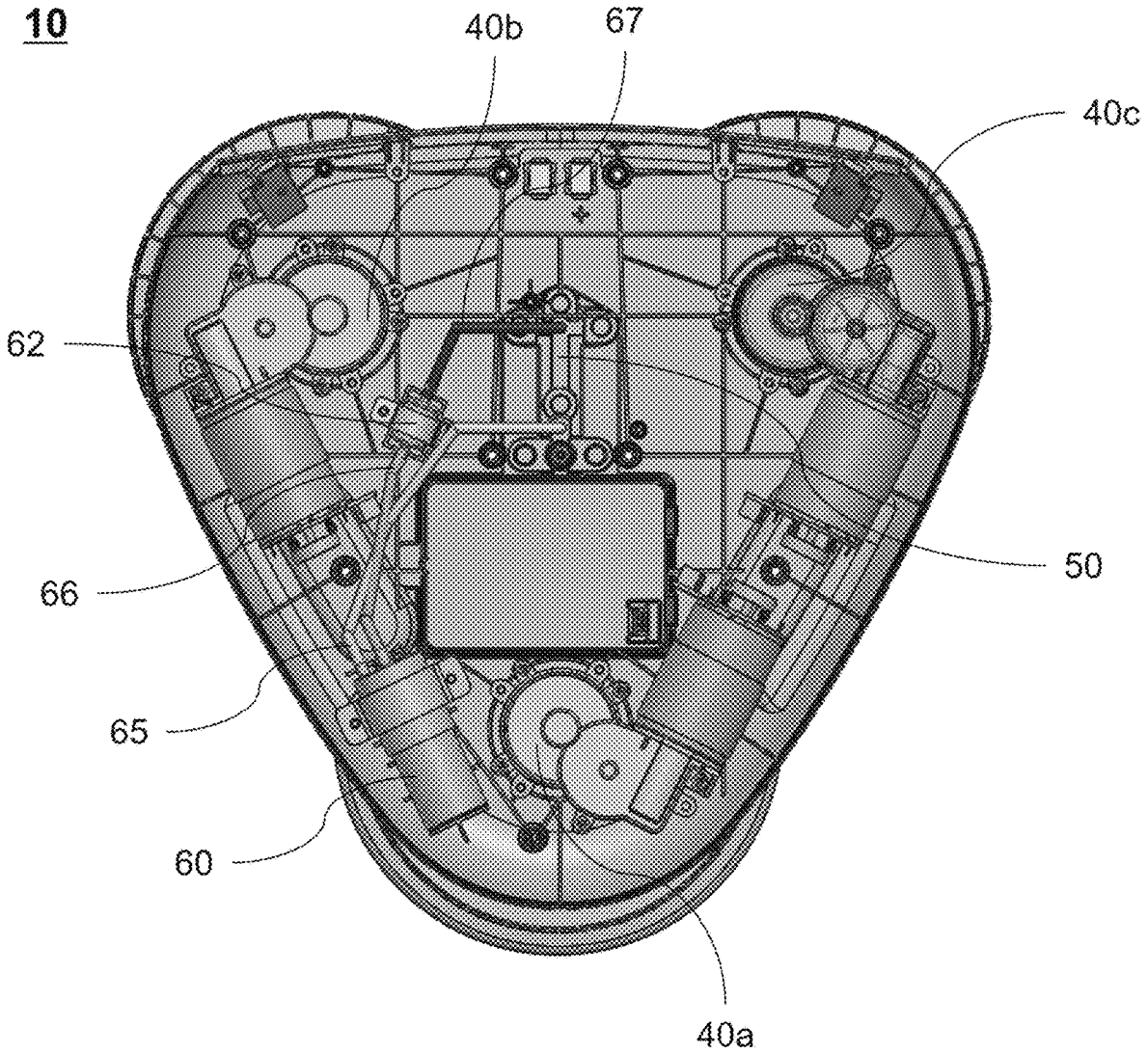

FIGS. 4 and 5 are views illustrating a flow path portion according to an exemplary embodiment of the present invention.

The flow path portion according to an exemplary embodiment of the present invention may include a pump 60, a check valve 62, a first flow path 64, a second flow path 65, a third flow path 66, and a fourth flow path 67 to be described below.

Referring to FIG. 4, the flow path portion may include the first flow path 64 (the arrow in FIG. 4) through which the liquid supplied from the liquid supply portion 30 first passes.

The first flow path 64 may be connected to the second flow path 65 as shown in FIG. 4.

As shown in FIG. 5, the flow path portion may include the pump 60 for moving the liquid passing through the flow path portion.

The liquid passing through the second flow path 65 may be pumped through the pump 60 and moved through the third flow path 66 connecting the pump 60 to the check valve 62.

The liquid passing through the third flow path 66 may pass through the check valve 62 and pass through the fourth flow path 67 connecting the check valve 62 to the liquid distribution member 50 to reach the liquid distribution member 50.

That is, the liquid supplied from the liquid supply portion 30 may sequentially pass through the first flow path 64, the second flow path 65, the pump 60, the third flow path 66, the check valve 62, and the fourth flow path 67 to reach the liquid distribution member 50.

Here, the check valve 62 may perform a function of preventing the liquid present in the flow path portion from being ejected to the outside of the robot cleaner 10 when the pump 60 does not operate.

For example, when the supply of liquid to the plurality of cleaners 42 is stopped by a user's operation, a specific cleaning algorithm, or a specific movement algorithm, the check valve 62 may prevent the liquid located in a front stage of the check valve 62 from passing through the check valve 62.

By the check valve 62, the liquid stored in the liquid supply portion 30 may be prevented from leaking to a surface to be cleaned, such as a room floor, due to a free fall motion.

Here, the first flow path 64, the second flow path 65, the third flow path 66, and the fourth flow path 67 may be formed of various materials.

For example, the first flow path 64 may be formed as a portion of the first lower case 23. In this case, the first flow path 64 may be formed of a rigid plastic material.

Also, for example, the second flow path 65, the third flow path 66, and the fourth flow path 67 may be formed of a flexible material such as a silicon material.

Meanwhile, the liquid distribution member 50 may be detachably coupled to a lower portion of the main body portion 20.

Figure 6:
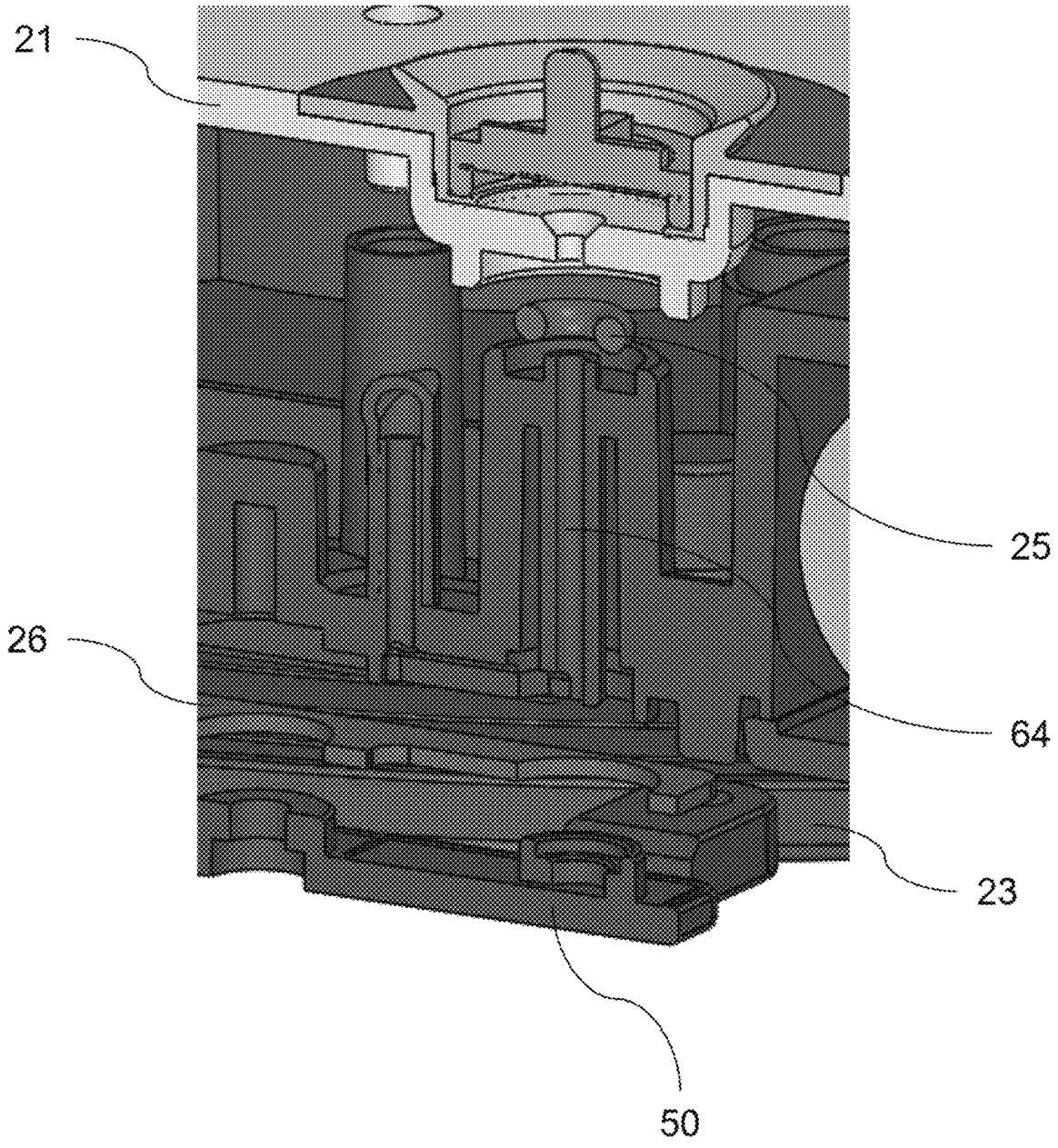
FIGS. 6 and 7 are views illustrating an example in which a liquid distribution member is coupled to a robot cleaner according to an exemplary embodiment of the present invention.
Figure 7:
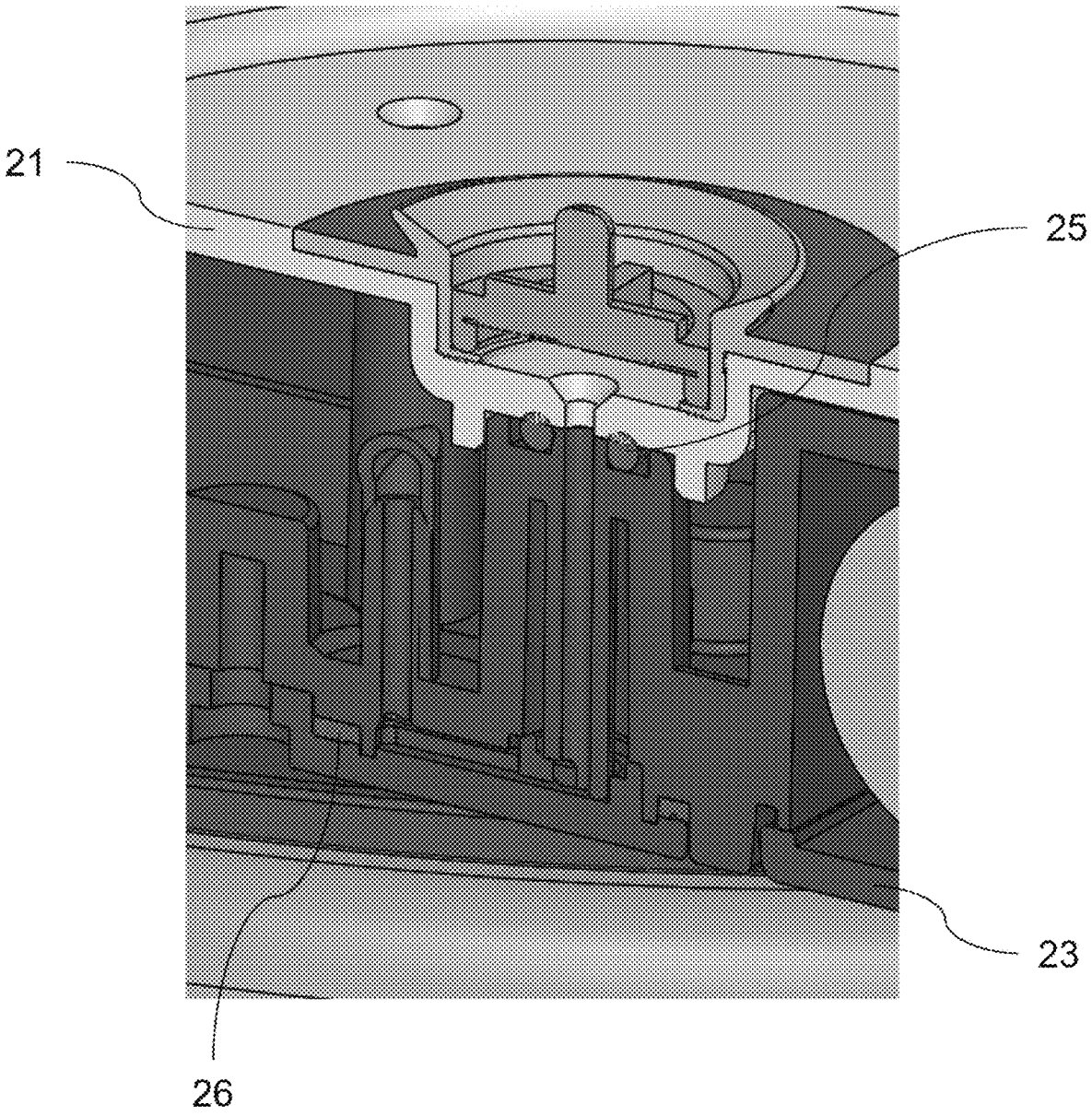

FIGS. 6 and 7 show an example in which the liquid distribution member according to an exemplary embodiment of the present invention is coupled to the robot cleaner.

Referring to FIG. 6, the liquid distribution member 50 may be coupled to the first lower case 23.

Also, referring to FIG. 6, a first water leakage preventing member 25 for preventing water leakage may be provided between the first upper case 21 and the first flow path 64 where the flow path portion starts.

Also, referring to FIG. 6, a second water leakage preventing member 26 for preventing water leakage may be provided between the first lower case 23 and the liquid distribution member 50.

For example, the first water leakage preventing member 25 and the second water leakage preventing member 26 may be formed of a packing made of a rubber material (e.g., nitrile-butadiene rubber (NBR) for maintaining airtightness.

FIG. 7 shows an example in which the first upper case 21, the first water leakage preventing member 25, the first lower case 23, the second water leakage preventing member 26, and the liquid distribution member 50 are coupled as described above.

Figure 8:
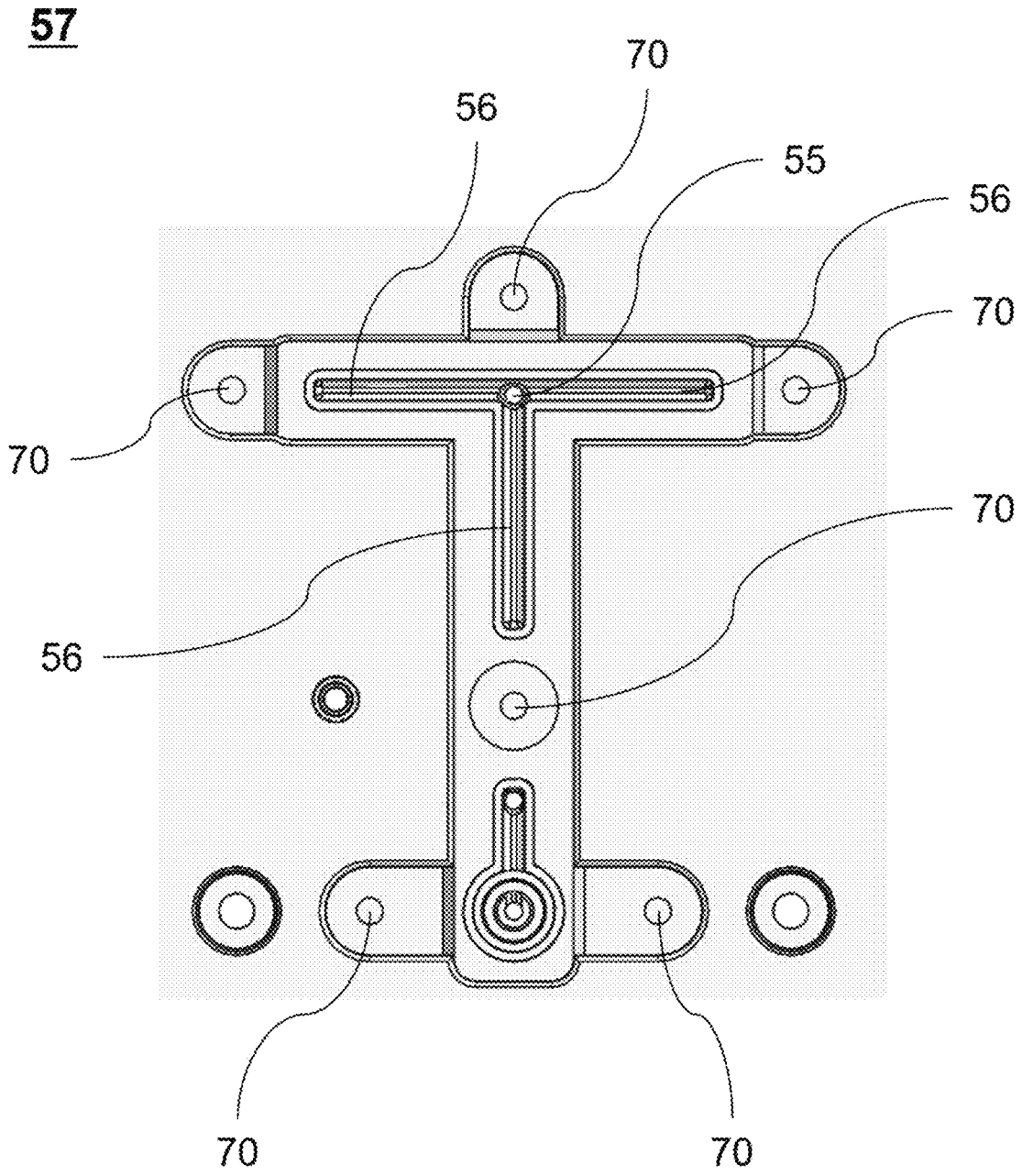
FIGS. 8 to 10 are views illustrating an example of the configuration of a liquid distribution member according to an exemplary embodiment of the present invention.
Figure 9:
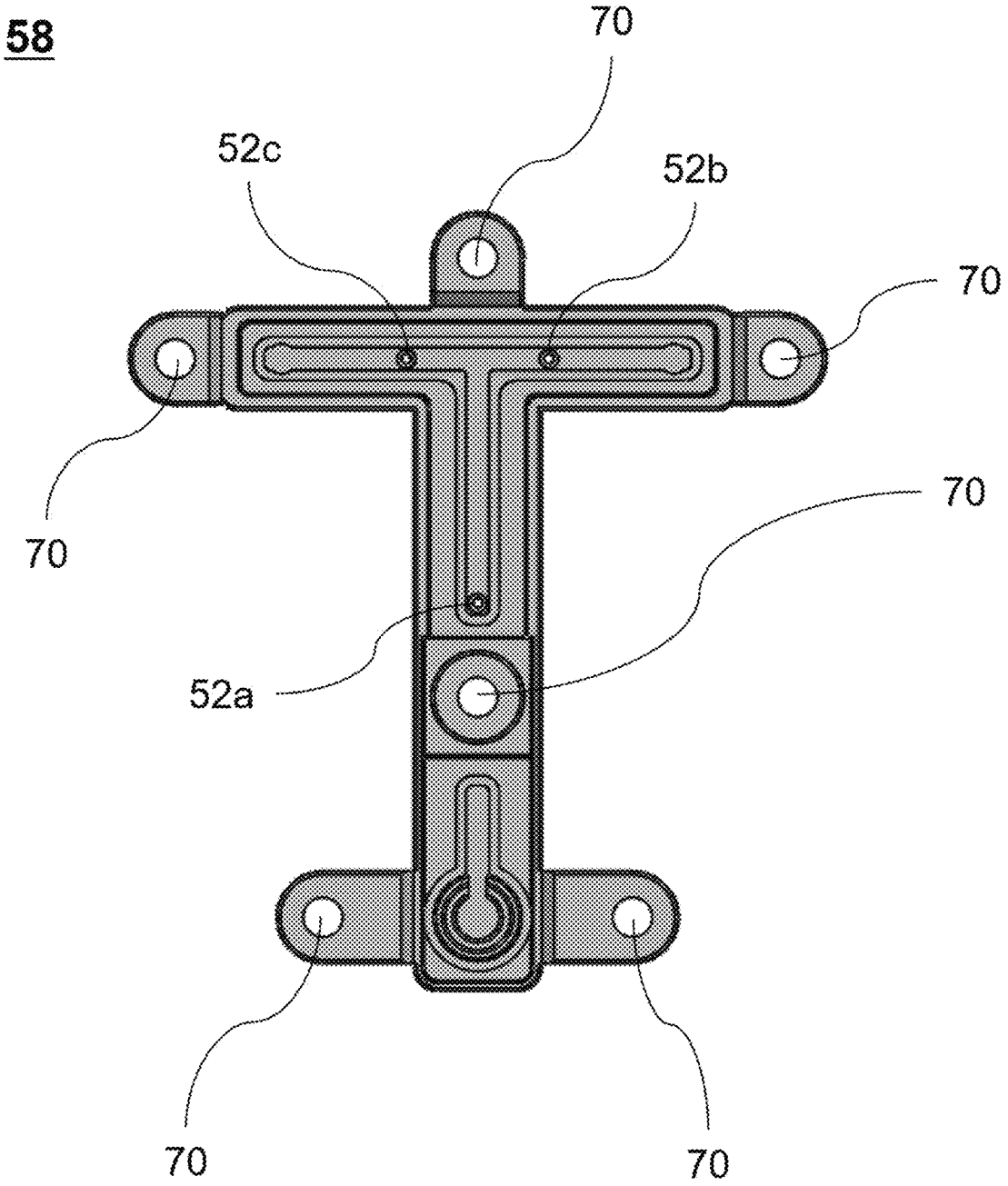
Figure 10:
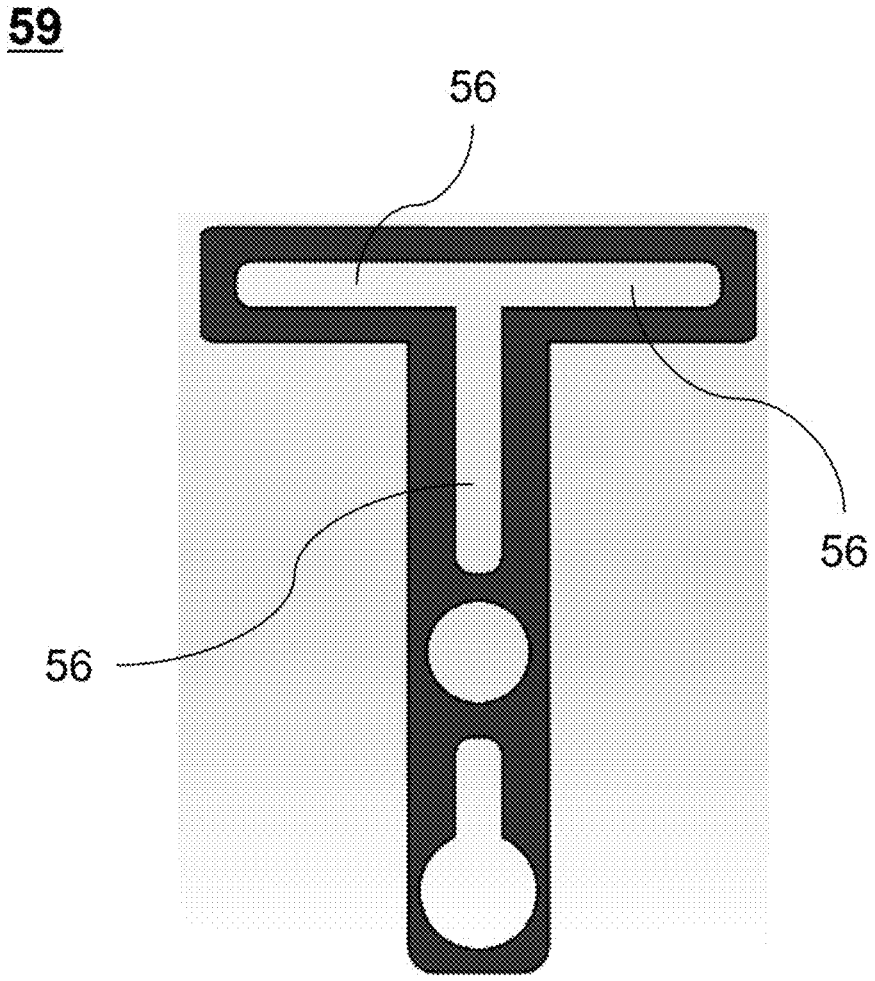

FIGS. 8 to 10 are views illustrating an example of a configuration of a liquid distribution member according to an exemplary embodiment of the present invention.

Referring to FIGS. 8 and 9, the liquid distribution member according to an exemplary embodiment of the present invention may include a second upper case 57 and a second lower case 58.

The second upper case 57 and the second lower case 58 may be coupled to each other to constitute a single housing.

That is, the second lower case 58 may be disposed to face a surface to be cleaned, such as a room floor.

Referring to FIGS. 8 and 9, a plurality of fastening portions 70 may be formed in the second upper case 57 and the second lower case 58, and the second upper case 57 and the second lower case 58 may be mounted on the first lower case 23 through the plurality of fastening portions 70.

For example, according to the configuration shown in FIGS. 8 and 9, screws may be fastened to the plurality of fastening portions 70 so that the second upper case 57 and the second lower case 58 may be installed in the first lower case 23.

Of course, a structure in which the liquid distribution member according to an exemplary embodiment of the present invention is coupled to the first lower case 23 is not limited to the configuration illustrated in FIGS. 8 and 9.

As described above, the liquid distribution member 50 according to an exemplary embodiment of the present invention may include a separate detachable unit (not shown) to be detachably coupled to the first lower case 23. In this case, the first lower case 23 may include a unit corresponding to the separate detachable unit provided on the liquid distribution member 50.

Meanwhile, referring to FIG. 10, a third water leakage preventing member 59 for preventing water leakage may be provided between the second upper case 57 and the second lower case 58.

The third water leakage preventing member 59 may be formed of a rubber packing for maintaining airtightness, like the first water leakage preventing member 25 and the second water leakage preventing member 26.

Meanwhile, it should be appreciated that the configuration of the liquid distribution member 50 is not limited to the configuration described above.

For example, as described above, the second upper case 57 may be a separate object from the main body portion 20 or may be integrally formed with the main body portion 20 at a lower portion of the main body portion 20.

For example, the second upper case 57 may be formed in the first lower case 23 included in the main body portion 20.

When the second upper case 57 is formed in the first lower case 23, the liquid distribution member 50 referred to in the present disclosure may include the third water leakage preventing member 59 and the second lower case 58, excluding the second upper case 57, or may include only the second lower case 58.

Of course, even when the second upper case 57 is formed in the first lower case 23, the liquid distribution member 50 referred to in the present disclosure may be understood as a concept including all the second upper case 57, the third water leakage preventing member 59, and the second lower case 58.

In addition, when the second upper case 57 is formed in the first lower case 23, the third water leakage preventing member 59 may be replaced with the second water leakage preventing member 26, so that the third water leakage preventing member 59 and the second water leakage preventing member 26 may be the same component.

Figure 11:
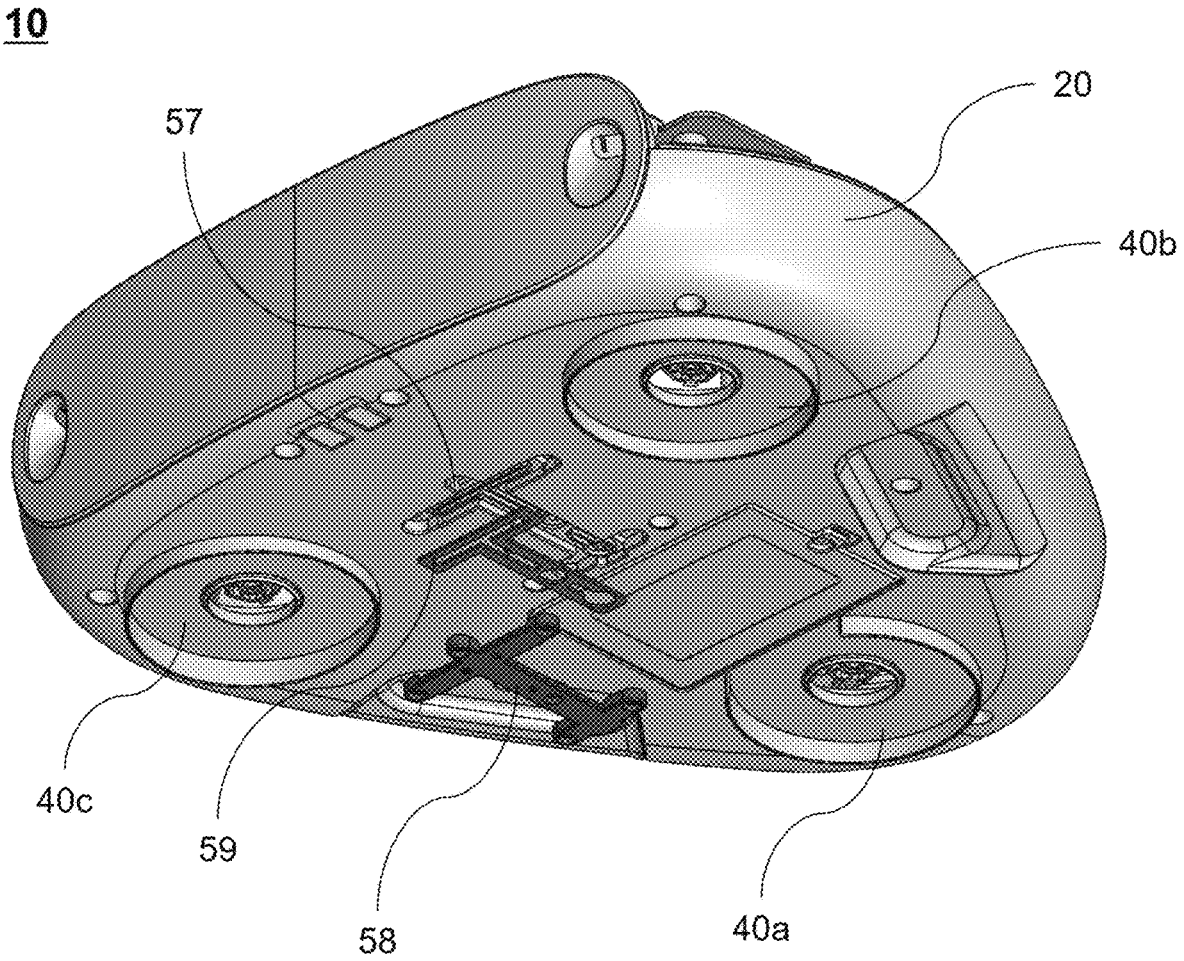
FIG. 11 is a diagram illustrating an example in which a liquid distribution member is coupled to a robot cleaner according to an exemplary embodiment of the present invention.

FIG. 11 is a diagram illustrating an example in which a liquid distribution member is coupled to a robot cleaner according to an exemplary embodiment of the present invention.

For example, referring to FIG. 11, the second upper case 57, the third water leakage preventing member 59, and the second lower case 58 shown in FIGS. 8 to 10 may be mounted on the first lower case 23 through the plurality of fastening portions 70.

Of course, referring to FIG. 11, as described above, the second upper case 57 may be previously formed in the second lower case 58, rather than being a separate independent component, and the second lower case 58 may be mounted in the first lower case 23 together with the second water leakage preventing member 26 or the third water leakage preventing member 59.

Also, referring to FIG. 8, a hole 55, to which the end of the flow path portion, that is, the end of the fourth flow path 67 may be coupled, may be formed in the upper portion of the liquid distribution member 50, that is, in the second upper case 57.

The liquid distribution member 50 may receive the liquid from the flow path portion through the hole 55.

Meanwhile, referring to FIG. 8, the liquid distribution member 50 may include a plurality of ducts 56 extending toward the plurality of cleaner fixing portions 40*a*, 40*b* and 40*c* formed therein.

Here, the plurality of ducts 56 may be interconnected as shown in FIG. 8.

The liquid supplied from the flow path portion through the hole 55 formed in the liquid distribution member 50 may be fill the plurality of ducts 56.

Figure 12:
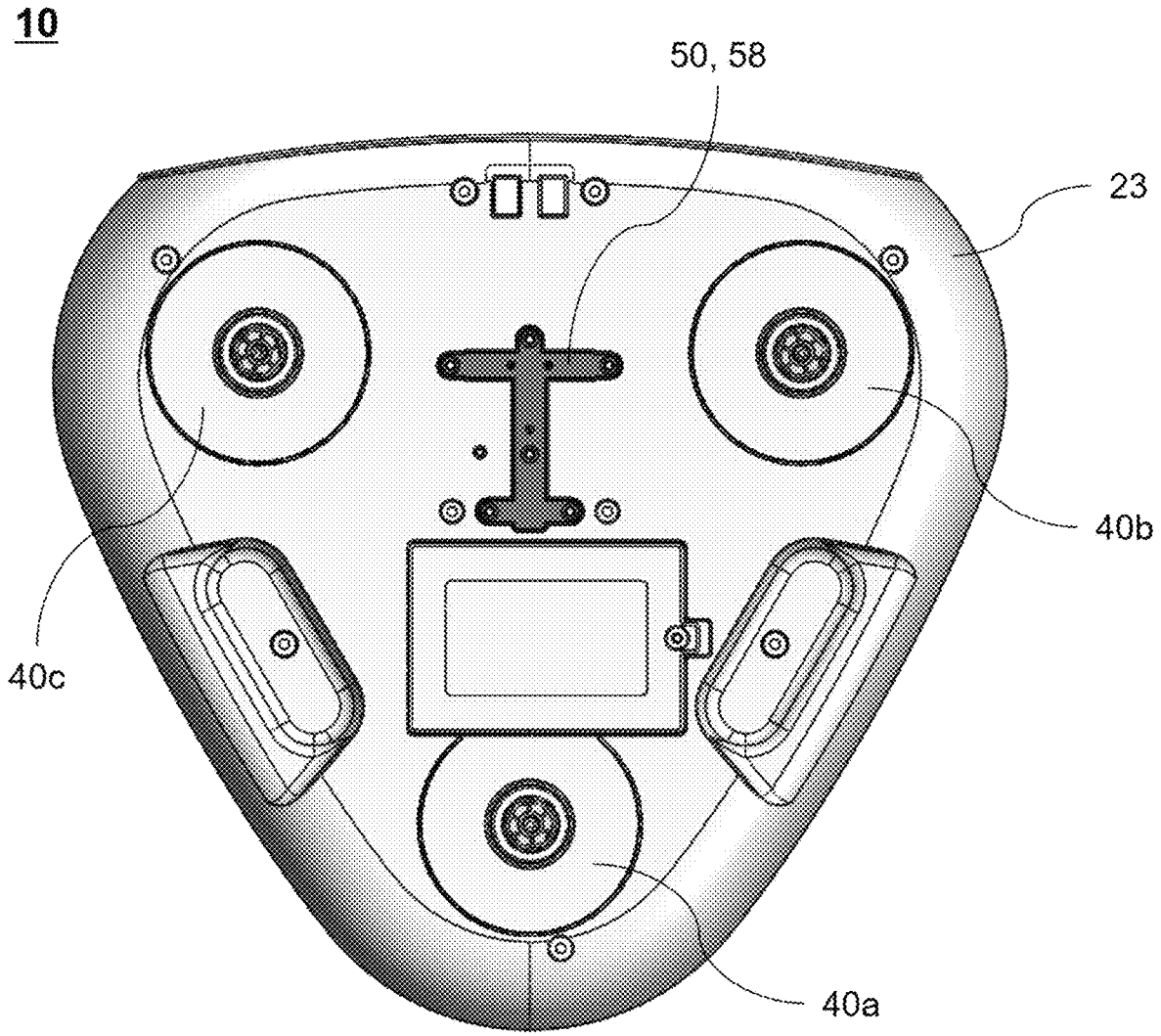
FIGS. 12 and 13 are views illustrating an example of a state in which a liquid distribution member is mounted on a lower portion of a robot cleaner according to an exemplary embodiment of the present invention.
Figure 13:
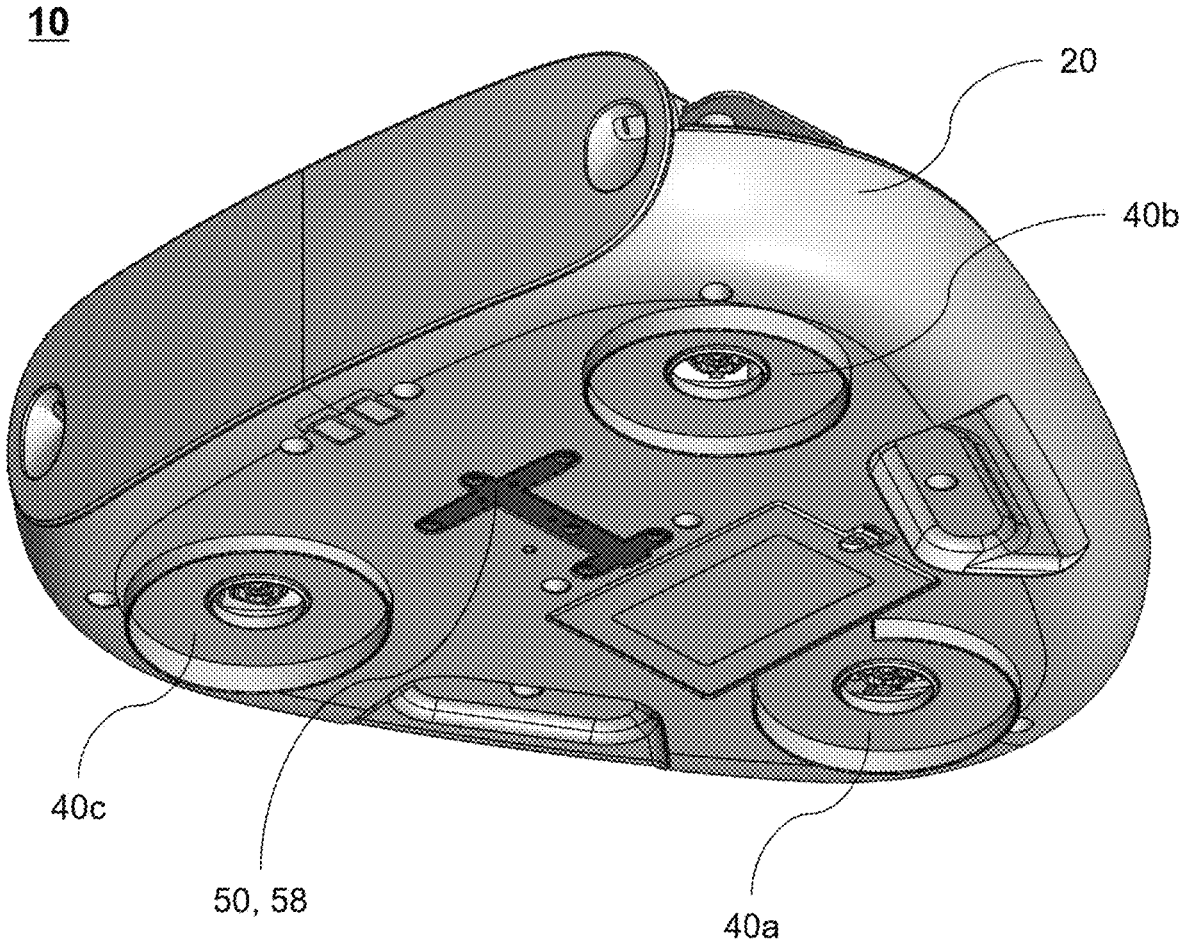

FIGS. 12 and 13 are views illustrating an example of a state in which a liquid distribution member is mounted at a lower portion of a robot cleaner according to an exemplary embodiment of the present invention.

Referring to FIGS. 11 to 13, the liquid distribution member 50 may be provided between the plurality of cleaner fixing portions 40 (three cleaner fixing portions in the present disclosure).

Meanwhile, referring to FIGS. 9 and 12, the liquid distribution member 50 may include at least one nozzle 52*a*, 52*b*, and 52*c*, through which the liquid filling the inside of the liquid distribution member 50 is ejected, may be provided in a position corresponding to at least one of the plurality of cleaners 42*a*, 42*b*, and 42*c*, respectively.

The at least one nozzle 52*a*, 52*b*, and 52*c* may be formed in the second lower case 58 as shown in FIG. 9.

In FIG. 9, the nozzles are provided at three positions respectively corresponding to all three cleaners, but the present invention is not limited thereto. For example, the nozzle corresponding to reference numeral 52*a* in FIG. 9 may not be formed.

The liquid may be directly supplied to a corresponding at least one cleaner among the plurality of cleaners 42*a*, 42*b*, and 42*c* through the at least one nozzle 52*a*, 52*b*, and 52*c*.

Figure 14:
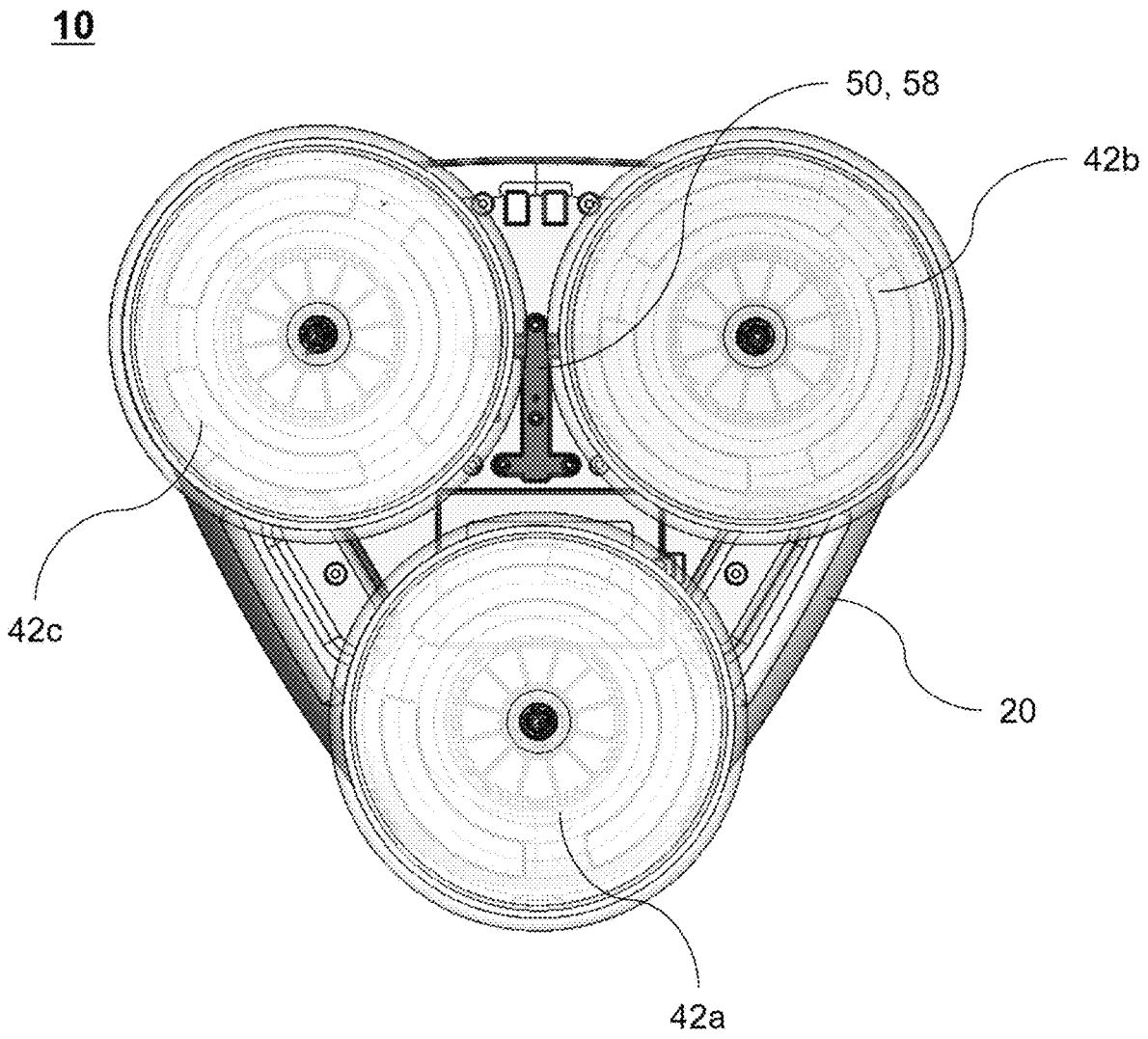
FIG. 14 is a view illustrating an example in which a liquid is supplied to a plurality of cleaners according to an exemplary embodiment of the present invention.
Figure 15:
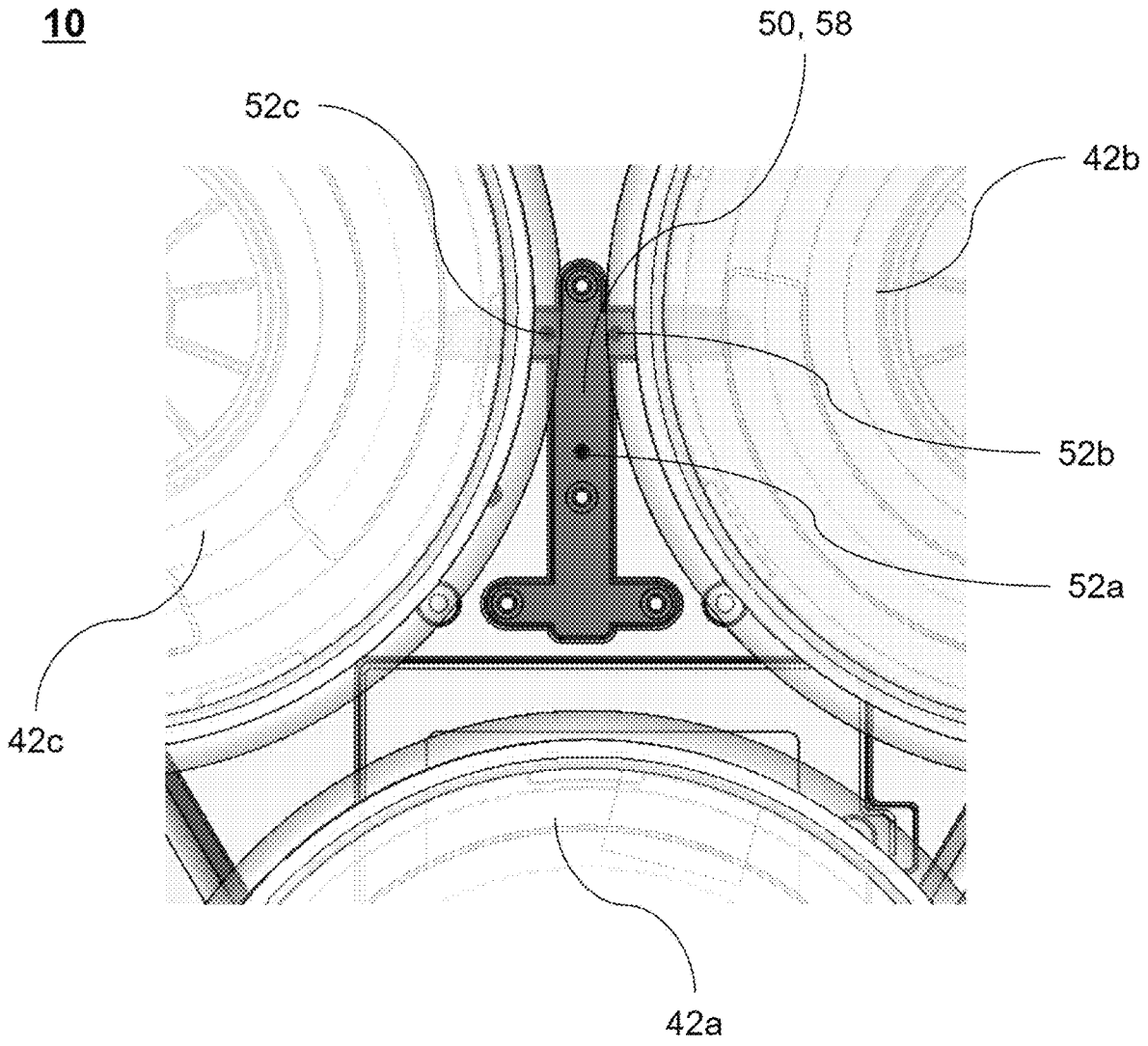
FIG. 15 is an enlarged view of a portion of a liquid distribution member in FIG. 14.

FIG. 14 is a view illustrating an example in which a liquid is supplied to a plurality of cleaners according to an exemplary embodiment of the present invention. FIG. 15 is an enlarged view of a portion of the liquid distribution member in FIG. 14.

Referring to FIGS. 9, 14, and 15, the liquid may be directly supplied to the second cleaner 42*b* through the second nozzle 52*b*, and the liquid may be directly supplied to the third cleaner 42*c* through the third nozzle 52*c*.

Meanwhile, the liquid may also be directly supplied to the first cleaner 42*a* through the first nozzle 52*a* (not shown).

However, FIGS. 14 and 15 show a structure in which the liquid ejected through the first nozzle 52*a* is not directly supplied to the first cleaner 42*a* but is supplied to the floor surface.

That is, when the at least one nozzle is provided in plurality, a specific nozzle among the plurality of nozzles 52*a*, 52*b*, and 52*c* may be disposed to face the floor surface so that the liquid may be directly supplied to the floor surface through the specific nozzle.

Referring to FIGS. 14 and 15, when the robot cleaner 10 moves upward, the liquid may be ejected to the floor surface, which is a surface to be cleaned, through the first nozzle 52*a*, and the first cleaner 42*a* may move upward to wipe the liquid ejected to the floor surface.

Designation of 'an exemplary embodiment' of the principles of the present invention and various modifications of such expression may mean that particular features, structures, characteristics, and the like, in relation to this exemplary embodiment are included in at least an exemplary embodiment of the principle of the present invention.

Thus, the expression 'an exemplary embodiment' and any other modifications disclosed throughout the entirety of the disclosure of the present invention may not necessarily designate the same exemplary embodiment.

In the present specification, in the case in which it is described that a method includes a series of steps, a sequence of these steps suggested herein is not necessarily a sequence in which these steps may be executed. That is, any described step may be omitted and/or any other step that is not described herein may be added to the method The terms of a singular form may include plural forms unless specifically mentioned. The meaning of "include or comprise", or "including or comprising" specifies a component, a step, an operation, an element, and a device but does not exclude other components, steps, operation, elements, and devices.

Hereinabove, the present invention has been described with reference to the exemplary embodiments thereof. All exemplary embodiments and conditional illustrations disclosed in the present specification have been described to intend to assist in the understanding of the principle and the concept of the present invention by those skilled in the art to which the present invention pertains. Therefore, it will be understood by those skilled in the art to which the present invention pertains that the present invention may be implemented in modified forms without departing from the spirit and scope of the present invention. Therefore, the exemplary embodiments disclosed herein should be considered in an illustrative aspect rather than a restrictive aspect.

The scope of the present invention is shown in the claims rather than the foregoing description, and all differences within the equivalent range should be interpreted as being included in the present invention.

The invention claimed is:

1. A robot cleaner comprising:

a main body portion;

a plurality of cleaner fixing portions provided at a lower portion of the main body portions;

a plurality of cleaners for wet cleaning being fixed to the plurality of cleaner fixing portions, respectively;

a liquid supply portion provided in the main body portion and storing a liquid and supplying the stored liquid to at least one of the plurality of cleaners;

a liquid distribution member provided at a lower portion of the main body portion and directly supplying the stored liquid to at least one cleaner of the plurality of cleaners; and a flow path portion providing a movement path of the liquid from the liquid supply portion to the liquid distribution member, wherein the flow path portion includes a pump for moving the liquid passing through the flow path portion and a check valve for preventing the liquid present in the flow path portion from being ejected to an outside of the robot cleaner when the pump does not operate, wherein the flow path portion further includes a first flow path through which the liquid supplied from the liquid supply portion passes first, a second flow path connecting the first flow path to the pump, a third flow path connecting the pump to the check valve, and a fourth flow path connecting the check valve to the liquid distribution member, and wherein the liquid supplied from the liquid supply portion reaches the liquid distribution member sequentially by passing through the first flow path, the second flow path, the pump, the third flow path, the check valve, and the fourth flow path.

2. The robot cleaner of claim 1, wherein the liquid distribution member has at least one nozzle, through which the liquid is ejected, at a position corresponding to the at least one cleaner, and the liquid is directly supplied to the at least one cleaner through the at least one nozzle.

3. The robot cleaner of claim 2, wherein the liquid distribution member is provided between the plurality of cleaner fixing portions.

4. The robot cleaner of claim 2, wherein the at least one nozzle is provided in plurality, and a specific nozzle, among the plurality of nozzles, is disposed to face a floor surface, so that the liquid is directly supplied to the floor surface through the specific nozzle.

5. The robot cleaner of claim 4, wherein the plurality of cleaners, the plurality of cleaner fixing portions, and the at least one nozzle each are three in number, the liquid distribution member is provided between the three cleaner fixing portions, and the specific nozzle among the three nozzles is provided in the liquid distribution member to directly supply the liquid to the floor surface, without directly supplying the liquid to any of the three cleaners.

6. The robot cleaner of claim 2, wherein a hole connected to an end of the flow path portion is formed at an upper portion of the liquid distribution member, the liquid is supplied from the flow path portion through the hole, and the at least one nozzle is formed at a lower portion of the liquid distribution member.

7. The robot cleaner of claim 6, wherein a plurality of ducts respectively extending toward the plurality of cleaner fixing portions are formed inside the liquid distribution member, and the plurality of ducts is filled with the liquid.

8. The robot cleaner of claim 6, wherein the liquid distribution member includes a second upper case and a second lower case coupled to each other, the hole is formed in the second upper case, and the at least one nozzle is formed in the second lower case.

9. The robot cleaner of claim 8, wherein the second upper case is formed integrally with the main body portion at a lower portion of the main body portion or is a separate object from the main body portion.

10. The robot cleaner of claim 9, wherein a third water leakage preventing member is provided between the second upper case and the second lower case.

11. The robot cleaner of claim 1, wherein the liquid distribution member is detachably connectable to the lower portion of the main body portion.

12. The robot cleaner of claim 1, wherein the main body portion includes a first upper case and a first lower case coupled to each other, the liquid distribution member is provided in the first lower case, a first water leakage preventing member is provided between the first upper case and the flow path portion, and a second water leakage preventing member is provided between the first lower case and the liquid distribution member.

13. The robot cleaner of claim 1, wherein the second flow path, the third flow path, and the fourth flow path are formed of a flexible material.

* * * * *